United States Patent [19]

Buono

[11] 4,270,664

[45] Jun. 2, 1981

[54] ONE PIECE CHILD RESISTANT CAP

[75] Inventor: Caetano Buono, Staten Island, N.Y.

[73] Assignee: Van Blarcom Closures, Inc., Brooklyn, N.Y.

[21] Appl. No.: 108,043

[22] Filed: Dec. 28, 1979

[51] Int. Cl.[3] ..... B65D 55/02

[52] U.S. Cl. ..... 215/216; 215/217; 215/330

[58] Field of Search ..... 215/216, 217, 330

[56] References Cited

U.S. PATENT DOCUMENTS

| | | | |
|---|---|---|---|
| 3,984,021 | 10/1976 | Uhlig | 215/216 |
| 3,993,209 | 11/1976 | Julian | 215/216 |

*Primary Examiner*—George T. Hall

*Attorney, Agent, or Firm*—James P. Malone

[57] ABSTRACT

One piece child resistant cap for containers. A container has a neck with a thread on its external surface. A first group of teeth is arranged in a line on said neck below the lower end of said thread. A second group of teeth is arranged in a line on said neck opposite said first group of teeth. A cap of flexible material having a cap thread engages the container thread. A third group of teeth on the inside of the lower portion of the cap is spaced below the cap threads. A fourth group of threads on the inside of the lower portion of the cap is located opposite the third group of teeth. Whereby when the cap is screwed on to the container, the cap teeth will engage the container teeth so that the cap cannot be unscrewed in conventional manner and so that the cap must be squeezed to release the engagement of the cap teeth and the container teeth. All the cap teeth and the container teeth are located along a spiral parallel to the thread whereby the cap may be tightly closed to eliminate leakage if the container is tipped over.

2 Claims, 6 Drawing Figures

ONE PIECE CHILD RESISTANT CAP

TECHNICAL FIELD

This invention relates to child resistant caps for medicines or other dangerous substances and more particularly to such means wherein the cap is constructed of one piece.

BACKGROUND ART

Conventional one piece child resistant caps such as shown in U.S. Pat. Nos. 3,941,268 and 4,117,945, have locking means which are released by squeezing the cap. However, the locking means employed have a loose fit which permits considerable movement of the cap without unlocking it, which movement may loosen the cap sufficiently to cause leakage if the cap is tipped, thereby defeating the purpose of the cap which is to prevent unauthorized delivery of the contents.

THE PRESENT INVENTION

The present invention provides a new and improved one piece child resistant cap which screws on to a container in a conventional manner. At the lower end of the cap are two groups of teeth which are adapted to engage two corresponding groups of teeth on the neck of the container or bottle. These teeth are mounted in a spiral configuration parallel to the threads on the neck of the container or bottle so that the cap may be tightly locked and cannot be backed off without releasing the entire locking mechanism thereby providing a leak proof container.

In the present invention, the locking mechanism is released by squeezing the cap along a line perpendicular to the line intersecting the two groups of teeth.

The cap of the present invention requires first that it be squeezed in the proper direction, and that it be turned counterclockwise at the same time. This compound motion will be beyond the capability of small children so that the cap will be child resistant.

Accordingly, a principal object of the invention is to provide new and improved one piece child resistant cap means.

Another object of the invention is to provide new and improved one piece child resistant cap means wherein the cap may be tightly screwed down and locked to make the container leak-proof in the locked position.

Another object of the invention is to provide new and improved one piece child resistant cap for containers comprising, a container having a neck with a thread on its external surface; a first group of teeth arranged in a line on said neck below the lower end of said thread; a second group of teeth arranged in a line on said neck opposite said first group of teeth; a cap of flexible material having a cap thread adapted to engage the container thread; a third group of teeth on the inside of the lower portion of the cap spaced below the cap threads; a fourth group of threads on the inside of the lower portion of the cap and opposite the third group of teeth; whereby when the cap is screwed on to the container the cap teeth will engage the container teeth so that the cap cannot be unscrewed in conventional manner so that the cap must be squeezed to release the engagement of the cap teeth and the container teeth.

These and other objects of the invention will be apparent from the following specification and drawings of which:

Figure 2:
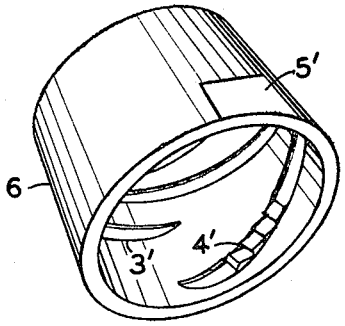
FIG. 2 is a perspective view of the cap for the embodiment of FIG. 1.
Figure 1:
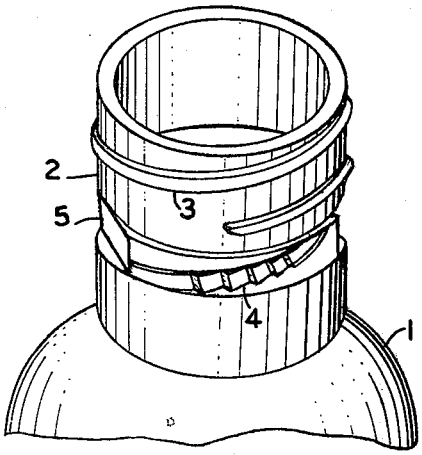
FIG. 1 is a perspective view of the neck of a container embodying the invention.

BEST MODE FOR CARRYING OUT THE INVENTION:

Referring to the Figures, FIGS. 1 and 2 show a perspective view of an embodiment of the invention. The container 1, has a neck 2, with an external thread 3. A first group of external locking teeth 4, are mounted on the lower end of the neck and they are arranged in a spiral configuration parallel to the thread 3. There is a corresponding group of locking teeth at the other side of the neck which are not shown in FIG. 1. The neck has a recess or flattened portion 5, and a corresponding portion on the other side. The portions 5, are along the line which is squeezed to release the locking teeth as will be explained.

FIG. 2 shows a perspective view of the cap 6 which has threads 3' which are adapted to engage the threads 3 on the neck of the container or bottle. At the lower end of the cap is a plurality of locking teeth 4', which are adapted to engage the teeth 4 on the neck of the bottle. This group of teeth, 4' is arranged along a spiral configuration which is parallel to the threads 3 and 3'. Therefore, the cap 6 can be screwed tightly on to the container or bottle so as to provide a leak-proof seal and due to the locking of the teeth 4, 4', the cap cannot be loosened sufficiently to cause any leakage unless the cap is completely released by the squeezing of the area 5.

Figure 3:
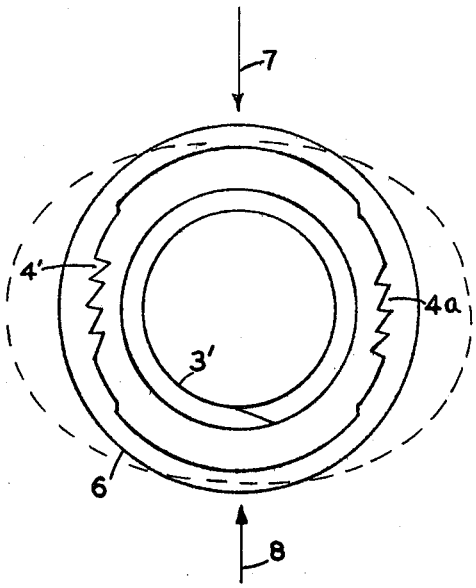
FIG. 3 is a bottom view of the cap of the present invention.
Figure 4:
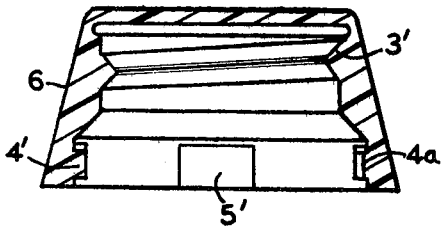
FIG. 4 is a sectional view of the cap of the present invention.

FIG. 3 shows a bottom view of the cap 6, and FIG. 4 shows a sectional view. FIG. 3 shows two groups of teeth 4' and **4*a*. FIG. 4 shows a sectional view of the cap showing the locking teeth 4' and 4*a* and the conventional thread 3'. The area 5 is a flattened area which is used for a finger grip in order to squeeze the cap along the squeezing line shown by the arrows 7 and 8. The cap is made of flexible material so that when the cap is squeezed along the arrows 7 and 8**, the cap will be deformed sufficiently, as shown by the dotted line, to release the locking teeth so that the cap can be unscrewed in conventional manner.

Figure 6:
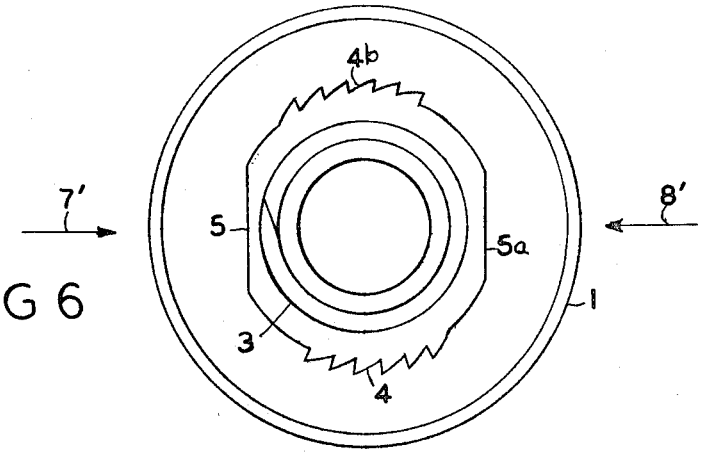
FIG. 6 is a top view of FIG. 5.
Figure 5:
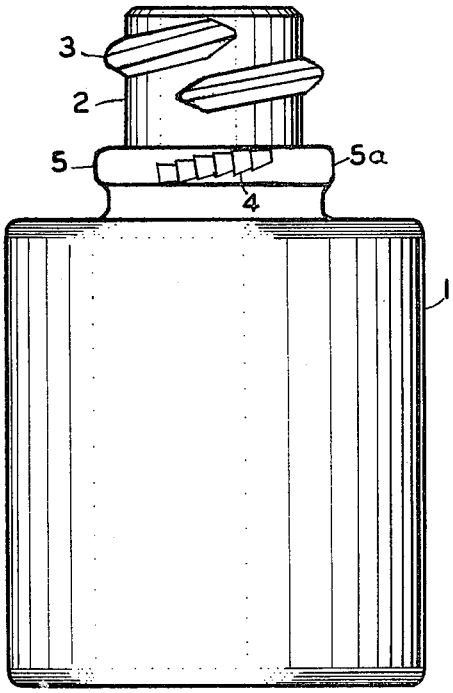
FIG. 5 is a side view of a container embodying the invention.

FIG. 5 shows a side view of the container and FIG. 6 shows a top view of the container.

FIG. 5 shows the conventional threads 3 and the group of external teeth 4 on the neck of the container or bottle 1.

FIG. 6 shows a top view of the container or bottle showing the first group 4 of external locking teeth, and a second group **4*b*, of external locking teeth. The neck 2 of the bottle or container has two flattened areas 5 and 5*a*, which are along the squeeze line illustrated by the arrows 7 and 8'**. The purpose of the flattened areas is to permit greater deforming movement of the cap to facilitate unlocking the locking teeth and to permit unscrewing of the cap in conventional manner. The cap may be of molded plastic, such as polyethylene or polypropylene.

Therefore, the cap of the present invention requires first that it be squeezed in the proper direction indicated by the areas 5', and that it be turned counter-clockwise at the same time. This compound motion will be beyond the capability of small children so that the cap will be child resistant.

It is claimed:

1. One piece child resistant cap for containers comprising:

a container having a neck with a thread on its external surface, a first group of teeth arranged in a line on said neck below the lower end of said thread, a second group of teeth arranged in a line on said neck opposite said first group of teeth, a cap of flexible material having a cap thread adapted to engage the container thread, a third group of teeth on the inside of the lower portion of the cap spaced below the cap threads, a fourth group of teeth on the inside of the lower portion of the cap and opposite the third group of teeth, all the cap teeth and the container teeth being located along a spiral parallel to said thread, whereby when the cap is screwed on to the container the cap teeth will engage the container teeth so that the cap cannot be unscrewed in conventional manner so that the cap must be squeezed to release the engagement of the cap teeth and the container teeth, and whereby the cap may be tightly closed to eliminate leakage if the container is tipped over.

2. Apparatus as in claim 1 wherein the neck of the container has a smaller dimension along the squeezing line to facilitate squeezing and removal of the cap.

* * * * *